US011708627B2

(12) United States Patent
Aoki et al.

(10) Patent No.: US 11,708,627 B2
(45) Date of Patent: Jul. 25, 2023

(54) NI-BASED SUPERALLOY AND METHOD FOR MANUFACTURING NI-BASED SUPERALLOY

(71) Applicant: PROTERIAL, LTD., Tokyo (JP)

(72) Inventors: Chuya Aoki, Tokyo (JP); Masayoshi Date, Tokyo (JP); Toshiki Ishida, Tokyo (JP)

(73) Assignee: PROTERIAL LTD., Tokyo (JP)

( * ) Notice: Subject to any disclaimer, the term of this patent is extended or adjusted under 35 U.S.C. 154(b) by 117 days.

(21) Appl. No.: 17/440,125

(22) PCT Filed: Mar. 24, 2020

(86) PCT No.: PCT/JP2020/012980
§ 371 (c)(1),
(2) Date: Sep. 16, 2021

(87) PCT Pub. No.: WO2020/203460
PCT Pub. Date: Oct. 8, 2020

(65) Prior Publication Data

US 2022/0154311 A1 May 19, 2022

(30) Foreign Application Priority Data

Mar. 29, 2019 (JP) ..... 2019-065236

(51) Int. Cl.
*C22C 19/05* (2006.01)
*C22F 1/10* (2006.01)

(52) U.S. Cl.
CPC ..... *C22C 19/055* (2013.01); *C22C 19/056* (2013.01); *C22F 1/10* (2013.01)

(58) Field of Classification Search
CPC ..... C22C 19/056; C22C 19/055; C22F 1/10
See application file for complete search history.

(56) References Cited

U.S. PATENT DOCUMENTS

2011/0061394 A1* 3/2011 Hawk ..... C22C 19/055 148/427
2012/0183432 A1* 7/2012 Devaux ..... C22C 1/023 420/448
2017/0275736 A1 9/2017 Abe et al.

FOREIGN PATENT DOCUMENTS

CN 101613833 A 12/2009
CN 103966476 A 8/2014
CN 105624469 A 6/2016
JP H0364435 A 3/1991
JP H10237609 A 9/1998
JP 2015054332 A 3/2015
JP 2015087119 A 5/2015
WO 2016052423 A1 4/2016

OTHER PUBLICATIONS

"First Office Action and English language translation", CN Application No. 202080015702.0, dated Jan. 30, 2022, 12 pp.
"Communication with Supplementary European Search Report", EP Application No. 20784184.2, dated Nov. 16, 2022, 10 pp.
Agnoli, A., et al., "Mechanical Properties Evolution of γ'/γ" Nickel-Base Superalloys During Long-Term Thermal Over-Aging", Metallurgical and Materials Transactions A, vol. 49A, No. 9, Jun. 29, 2018, pp. 4290-4300.
Agnoli, Andrea, et al., "Selective Growth of Low Stored Energy Grains During δ Sub-solvus Annealing in the Inconel 718 Nickel-Based Superalloy", Metallurgical and Materials Transactions A, vol. 46A, No. 9, Jul. 8, 2015, pp. 4405-4421.
Horvath, W., et al., "The Effectiveness of Direct Aging on Inconel 718 Forgings Produced at High Strain Rates as Obtained on a Screw Press", Superalloys 718, 625, 706 and Various Derivatives: Proceedings of the International Symposium on Superalloys 718, 625, 706 and Various Derivatives, held Jun. 17-20, 2001, Warrendale, PA: The Minerals, Metals & Materials Society, Jun. 2001, pp. 223-228.
Krishna, S. Chenna , et al., "Processing and Characterization of Sub-delta Solvus Forged Hemispherical Forgings of Inconel 718", Journal of Materials Engineering and Performance, vol. 25, No. 12, Oct. 13, 2016, pp. 5477-5485.
"English language translation of International Search Report", International Application No. PCT/JP2020/012980, dated Jun. 23, 2020, 2 pp.

* cited by examiner

*Primary Examiner* — Jessee R Roe
(74) *Attorney, Agent, or Firm* — Myers Bigel, P.A.

(57) ABSTRACT

Provided are a Ni-based superalloy for stably obtaining high tensile strength and a method for manufacturing the same. Provided are: a Ni-based superalloy having a composition comprising, in mass %, C: up to 0.10%, Si: up to 0.5%, Mn: up to 0.5%, P: up to 0.05%, S: up to 0.050%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities, and has a grain orientation spread (GOS) of at least 0.7° as an intragranular misorientation parameter measured by an SEM-EBSD technique; and a method for manufacturing the same.

5 Claims, No Drawings

NI-BASED SUPERALLOY AND METHOD FOR MANUFACTURING NI-BASED SUPERALLOY

RELATED APPLICATIONS

This application is a 35 U.S.C. § 371 national stage application of PCT Application No. PCT/JP2020/012980, filed on Mar. 24, 2020, which claims priority from Japanese Patent Application No. 2019-065236, filed on Mar. 29, 2019, the contents of which are incorporated herein by reference in their entireties. The above-referenced PCT International Application was published in the Japanese language as International Publication No. WO 2020/203460 A1 on Oct. 8, 2020.

TECHNICAL FIELD

The present invention relates to Ni-based superalloys and to methods for manufacturing Ni-based superalloys.

BACKGROUND ART

For jet engines for aircraft and gas turbines for power generation, operating temperature tend to be increased in order to enhance fuel efficiency, and therefore, many components made from Ni-based superalloys are used, the Ni-based superalloy having excellent mechanical properties at high temperatures. Examples of representative alloys include alloy 718 and Waspaloy. The rotary components using such alloys in jet engines and gas turbines require good tensile strength, fatigue properties, and creep properties at high temperatures.

Among known alloys described above, for example, using alloy 718, various manufacturing methods suitable for gas turbine discs for power generation have been proposed. For example, in JP H10-237609 A (Patent Document 1), focusing on cooling rate after solution heat treatment, by setting an average cooling rate from a solution treatment temperature to 600° C. in a range of 5 to 50° C./min, improvement in strength, creep, and the like, has been proposed.

REFERENCE DOCUMENT LIST

Patent Document

Patent Document 1: JP H10-237609 A

SUMMARY OF THE INVENTION

Problem to be Solved by the Invention

Among components which are used in jet engines for aircraft and gas turbines for power generation and are made of Ni-based heat superalloys, for example, a member for a turbine disc is subjected to closed die forging to form it into near net shape of the product. The members for which tensile strength is considered important desirably have an ASTM grain size number of 8 or more in accordance with, and an effective technique is to uniformly introduce plastic strain into a workpiece material during forging, and recrystallize the entire workpiece material, thereby obtaining fine grains.

However, when the workpiece material is subjected to closed die forging, a portion (dead zone) restricted by a die inevitably exists during forging, thereby forming a region where introduced plastic strain is low in the workpiece material. In such a region, grains may grow abnormally during a solution heat treatment after forging, thereby not yielding the required tensile strength.

An object of the present invention is to provide a Ni-based superalloy having high tensile strength and a method for manufacturing the same.

Means for Solving the Problem

As described above, as a technique for obtaining high tensile strength, an effective method is to refine grains utilizing recrystallization. On the other hand, the present inventors discovered that plastic strain, which is introduced during forging, could be deliberately caused to remain in the workpiece material without promoting recrystallization, and thus, a Ni-based superalloy having high tensile strength could be obtained and the strain stored therein could be determined by the grain orientation spread (GOS) as an intragranular misorientation parameter. In addition, the present inventors discovered a manufacturing method causing plastic strain to remain to achieve the present invention.

That is, in the present invention, a Ni-based superalloy has a composition comprising, in mass %, C: up to 0.10%, Si: up to 0.5%, Mn: up to 0.5%, P: up to 0.05%, S: up to 0.050%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities, and has a grain orientation spread (GOS) of at least 0.7° as an intragranular misorientation parameter measured by an SEM-EBSD technique.

In addition, in the present invention, the Ni-based superalloy has a composition of the Ni-based superalloy comprising C: up to 0.08%, Si: up to 0.2%, Mn: up to 0.2%, P: up to 0.02%, S: up to 0.005%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities.

The present invention provides a method for manufacturing the Ni-based superalloy, including: carrying out a heat treatment before closed die forging by heating a material to be hot-worked having the composition mentioned above at a temperature of 970 to 1,005° C. and holding at the temperature for 1 to 6 hours, and then carrying out closed die forging to produce a closed die forged material; and carrying out an aging treatment step comprising a first aging treatment by holding the closed die forged material at a temperature of 700 to 750° C. for 2 to 20 hours, and a second aging treatment by holding at a temperature of 600 to 650° C. for 2 to 20 hours to produce an aging-treated material.

In addition, the present invention provides a method for manufacturing the Ni-based superalloy, including: carrying out a heat treatment before four-face forging by heating a material to be hot-worked having the composition to a temperature of 980 to 1,050° C. and holding at that temperature for 1 to 6 hours, and then carrying out four-face forging to produce a four-face forged material; carrying out a stabilizing treatment step by holding the four-face forged material at a temperature of 830 to 860° C. for 2 to 20 hours to produce a stabilizing-treated material; and carrying out an aging treatment step by holding the stabilizing-treated material at a temperature of 740 to 780° C. for 2 to 20 hours to produce an aging-treated material, in which a cooling rate is faster than 15° C./min from a temperature at which the four-face forging is finished to 900° C.

Effects of the Invention

In a Ni-based superalloy in the present invention, excellent tensile strength can be obtained. The reliability of members in jet engines for aircraft and gas turbines for power generation, produced by using the Ni-based superalloy, can be enhanced.

MODE FOR CARRYING OUT THE INVENTION

The reasons for limiting the chemical composition of a Ni-based superalloy specified herein are as follows. The lower limit of each element indicated by "or less" includes 0%.

C

C forms MC carbides or $M_{23}C_6$ carbides in an alloy. The former has a pinning effect of suppressing the growth of grains and the latter is precipitated in a grain boundary, thereby enhancing grain boundary strength. However, the amount added is increased, and coarse MC carbides are formed, which are origins of fracture and cause deterioration in fatigue properties. Therefore, the content of C was specified as 0.10% or less. The upper limit is preferably 0.08%. When C is contained and the effect of C is reliably obtained, it is preferable that the lower limit of C be 0.01%. When the effect of carbides is not required, C need not be added.

Si, Mn, P, S Since Si, Mn, P and S deteriorate grain boundary strength, their content is preferably small, and each of them may be 0%. However, when this superalloy is used for members in jet engines for aircraft and gas turbines for power generation, sufficient strength can be obtained even if certain amounts thereof are contained, and therefore, a range in which Si is 0.5% or less, Mn is 0.5% or less, P is 0.05% or less, and S is 0.050% or less is acceptable. A range in which Si is 0.2% or less, Mn is 0.2% or less, P is 0.02% or less, and S is 0.005% or less is preferable.

Fe

Fe is a primary element constituting an alloy with Ni in the present invention, is used as a substitute for expensive Ni, and is effective in reducing alloy costs. However, when excessive Fe is contained, an embrittlement phase such as a σ phase (sigma phase) is formed, thereby deteriorating mechanical properties and hot workability. Therefore, the content of Fe is specified to be 45% or less. When synergistic effects generated by other elements are impaired due to the addition of Fe, thereby making it difficult to obtain desired characteristics, Fe need not be added.

Cr

Cr is an effective element for enhancing oxidation resistance and corrosion resistance in an environment in which this superalloy is used. In addition, Cr has an effect of increasing grain boundary strength by forming $M_{23}C_6$ carbides. In order to exhibit these effects, the content needs to be at least 14.0%. On the other hand, when Cr is excessively contained, an embrittlement phase such as a σ phase is formed, thereby deteriorating mechanical properties and hot workability. Therefore, the upper limit is specified as 22.0%. If the synergistic effects generated by other elements are impaired due to the addition of Cr, thereby making it difficult to obtain desired properties, Cr need not be added.

Co

Co can enhance stability of the structure at a high temperature to obtain high tensile strength. However, since Co is an expensive element among the contained elements, the content is specified as 18.0% or less to reduce alloy costs. When Co is contained and the effect of Co is reliably obtained, it is preferable that the lower limit of Co be specified as 5%. When the same effects obtained by adding Co can be obtained by using elements other than Co, Co need not be added.

Mo, W

Mo and W contribute to solid solution strengthening of a matrix and have an effect of increasing tensile strength at high temperatures. However, when Mo and W are excessively contained, an intermetallic compound phase is formed, thereby actually impairing strength. Therefore, the upper limits are specified to be 8.0% and 5.0%, respectively. When Mo and/or W are contained, and the effects of Mo and W are reliably obtained, it is preferable that the lower limit of Mo be specified as 1% and that the lower limit of W be specified as 1%. When the same effect obtained by adding Mo and W can be obtained by using elements other than Mo and W, Mo and W need not be added.

Al

Al is an element which forms a γ' phase (gamma prime phase) that is a precipitation-strengthening phase and enhances tensile strength. The content needs to be at least 0.10% in order to obtain the effect, but a large amount of γ' phases are precipitated by excessive addition, thereby deteriorating hot workability. Therefore, the upper limit is specified as 2.80%.

Ti

Like Al, Ti is also an element which forms a γ' phase and enhances tensile strength, and its effects can be obtained at a content of at least 0.50%. On the other hand, when added in excess, an phase (eta phase) that is an embrittlement phase is precipitated, thereby significantly deteriorating hot workability and mechanical properties. Therefore, the upper limit is specified as 5.50%.

Nb

Like Al or Ti, Nb is also an element which forms a γ' phase and leads to solid solution strengthening of the γ' phase to increase high-temperature strength. In addition, for example, in alloy 718, Nb is used for forming a γ" phase (gamma double prime phase) that is a precipitation-strengthening phase to increase strength and forming a δ phase required as pinning grains to control grain sizes. However, since hot workability is significantly impaired by excessive addition, the upper limit is specified as 5.8%. When Nb is contained and the effect of Nb is reliably obtained, it is preferable that the lower limit of Nb be specified as 1%. When the same effects obtained by adding Nb can be obtained by using elements other than Nb, Nb need not be added.

Ta

Like Al or Ti, Ta is also an element which forms a γ' phase and leads to solid solution strengthening of the γ' phase to increase high-temperature strength. In addition, Ta has a pinning effect of suppressing the growth of grains by forming MC carbides. However, since Ta is a very expensive element, the content is specified as 2.0% or less in order to hold down alloy costs. When Ta is contained and the effects of Ta are reliably obtained, it is preferable that the lower limit of Ta be specified as 0.5%. When the same effects obtained by adding Ta can be obtained by using elements other than Ta, Ta need not be added.

V

Like Ta, V is also an element which not only leads to solid solution strengthening of the γ' phase to increase high-temperature strength, but it is also used for forming MC carbides, serving as pinning grains to control grain sizes. However, since excessive addition causes coarsening of MC carbides, thereby deteriorating fatigue properties and hot workability, the content is specified as 1.0% or less. When V is contained and the effect of V is reliably obtained, it is preferable that the lower limit of V be specified as 0.5%. When the same effect obtained by adding V can be obtained by using elements other than V, V need not be added.

B

B is an element which enhances grain boundary strength and mainly improves creep strength and ductility. On the other hand, an effect of reducing the melting point by B is large, and excessive addition actually causes deterioration in grain boundary strength. In addition, when coarse borides are formed, hot workability is deteriorated, and therefore, the upper limit is specified as 0.030%. When B is contained and the effect of B is reliably obtained, it is preferable that the lower limit of B be specified as 0.005%. When the same effects obtained by adding B can be obtained by using elements other than B, B need not be added.

Zr

Like B, Zr enhances grain boundary strength, but excessive addition causes a reduction in melting point and deterioration in hot workability, and therefore, the upper limit is specified as 0.10%. When Zr is contained and the effect of Zr is reliably obtained, it is preferable that the lower limit of Zr be specified as 0.01%. When the same effect obtained by adding Zr can be obtained by using elements other than Zr, Zr need not be added.

Mg

Mg has an effect of fixing S as a sulfide and has an effect of improving hot workability. However, since ductility is deteriorated due to excessive addition, the content is specified as 0.005% or less. When Mg is contained and the effect of Mg is reliably obtained, it is preferable that the lower limit of Mg be specified as 0.0005%. When the same effect obtained by adding Mg can be obtained by using elements other than Mg, Mg need not be added.

Balance

The balance includes Ni and inevitable impurities. For example, such as alloy 718, at least 51% of Ni is preferably contained in order to obtain excellent high-temperature strength by the synergistic effect of a certain amount or more of Ni and other elements described above.

The term "Ni-based superalloy" described herein means a Ni-based alloy which is also referred to as a superalloy, and a heat resistant superalloy is used in a high-temperature region of 600° C. or higher, and an alloy which is strengthened by a precipitation phase such as γ'. Examples of representative alloys in a range of alloying elements described above include alloy 718 and Waspaloy.

Microstructure

An important component in the present invention is an intragranular misorientation parameter (GOS). The GOS is generally measured by an SEM-EBSD technique and is obtained by calculating the misorientations between points (pixels) constituting grains and averaging the obtained values. That is, the GOS indirectly represents the magnitude of strain in grains, and when the GOS is at least 0.7°, a Ni-based superalloy having tensile strength required for members in jet engines for aircraft and gas turbines for power generation can be obtained. For members for which ductility is considered to be particularly important among members in jet engines for aircraft and gas turbines for power generation, when the GOS is specified to be at least 0.7°, members having both tensile strength and ductility in good balance can be produced. The relationship between the GOS and tensile strength will be further described in Examples below. The upper limit of the GOS is not particularly limited, but it can be approximately 10°. Even if the GOS is over 10°, effects of further improving tensile strength and balance between tensile strength and ductility are saturated. The GOS is preferably specified to be at least 0.9°.

Manufacturing Method 1

Next, a preferable manufacturing method for obtaining the microstructure described above will be described. A method described herein is a method for carrying out hot-closed die forging and is a suitable method when forming into a near net shape using a pair of upper and lower dies having die faces.

First, a material to be hot-worked having this composition is subjected to a heat treatment before closed die forging by heating to 970 to 1,005° C. and holding it for 1 to 6 hours, followed by carrying out closed die forging to produce a closed die forged material in which a plastic strain of at least 0.1 is introduced. Hot workability required for closed die forging is ensured by setting to at least 970° C. However, when the material to be hot-worked is excessively heated, the introduced plastic strain is easily lost due to recrystallization, and a GOS of at least 0.7° may not be obtained, depending on the shape of the product, and therefore, the temperature is specified to be 1,005° C. or lower. The lower limit of the temperature of the heat treatment before forging is preferably 980° C., and the upper limit is preferably 1,000° C. The forging temperature can be 980° C. or lower. The forging temperature is lower than the heating temperature before forging because of the drop in temperature that occurs until the material to be hot-worked is taken out of a heating furnace and placed on the lower die provided in a hot forging apparatus and the drop in temperature generated by heat is absorbed by the lower die. As to the temperature of the material to be hot-worked by closed die forging in a hot state, a portion in contact with the die, a portion at which the temperature rises in processing is generated, and the like, are included. As to the forging temperature of the material to be hot-worked during closed die forging, it is difficult to accurately measure the temperature of the portion in contact with the die. Therefore, as to the forging temperature, the upper limit of the highest temperature in a portion in which the temperature can be confirmed is specified to be 980° C.

The plasticity-induced heating is generated by this hot forging, and the upper limit of plasticity-induced heating is preferably specified as 980° C. as described above. When the forging temperature is over 980° C., the accumulation of plastic strain introduced by closed die forging is reduced, resulting in reduction in proof stress. Therefore, the upper limit of the forging temperature is preferably 980° C.

When cooling a closed die forged material formed into a prescribed shape by closed die forging, when the cooling rate from the temperature at which forging was completed to 900° C. is preferably specified to be at least 20° C./min, which is a high cooling rate, the loss of plastic strain stored in the workpiece material due to recrystallization and abnormal growth of grains can be further reduced, and therefore, a Ni-based superalloy having a GOS of at least 0.7° can be easily obtained. Similarly, plastic strain stored in the workpiece material may be easily reduced due to structural changes, such as recrystallization, during a solution heat treatment. Consequently, a direct aging treatment is effective as a heat treatment to maintain a high GOS of at least 0.7°. As described above, the material to be hot-worked during hot forging has a portion at which the plasticity-induced heating is generated and a portion at which the temperature drops due to being in contact with the die. The phrase "the cooling rate from the temperature at which forging is completed to 900° C." above means a cooling rate from the temperature of a portion over 900° C. due to the plasticity-induced heating and the like at the time when closed die forging has been completed.

Next, in the present invention, without a solution heat treatment, the closed die forged material is held at a temperature of 700 to 750° C. for 2 to 20 hours as the first aging treatment, and is held at a temperature of 600 to 650° C. for 2 to 20 hours as the second aging treatment, to produce an aging-treated material. Accordingly, a γ' phase and a γ" phase, which are precipitation-strengthening phases, can be finely precipitated while maintaining high GOS of the closed die forged material. Accordingly, excellent tensile strength can easily be obtained at a high temperature.

As to the aging treatment, the aging treatment can be directly applied during the cooling of the closed die forged material, or the closed die forged material can be cooled once to around room temperature, followed by reheating to the temperature of a first aging treatment.

In addition, when the closed die forged material is produced to have fine grains having a grain size number of 8 or more according to ASTM, excellent tensile strength can be obtained more reliably.

Manufacturing Method 2

Next, for members for which ductility in addition to tensile strength is considered important, a preferable manufacturing method for obtaining the microstructure described above will be described. In this method, a four-face forged material is obtained by the workpiece material being moved relatively with respect to an anvil while being rotated, and being pressed by the anvil from the four directions in a hot state, that is, so-called radial forging. This method is a suitable method when a long stretch-forged material is obtained.

First, a material to be hot-worked having this composition is subjected to a heat treatment before forging by heating it to 980 to 1,050° C. and holding it for 1 to 6 hours, followed by carrying out four-face forging to produce a four-face forged material in which a plastic strain of at least 0.1 is introduced. Hot workability required for four-face forging is ensured by setting it to 980° C. or higher. However, when the material to be hot-worked is excessively heated, the introduced plastic strain is easily lost due to recrystallization, and thus, a GOS of at least 0.7° may not be obtained, depending on the shape of the product, and therefore, the temperature is specified to be 1,050° C. or lower. The lower limit of the temperature of the heat treatment before forging is preferably 990° C., and the upper limit thereof is preferably 1,040° C. The forging temperature can be from 950 to 1,070° C.

Upon cooling a forged material formed into a prescribed shape by four-face forging, the forged material is cooled at a cooling rate faster than 15° C./min from the temperature at which forging is finished to 900° C., thereby further reducing the loss of plastic strain stored in the workpiece material due to recrystallization and abnormal grain, and therefore a Ni-based superalloy having a GOS of at least 0.7° can easily be obtained. The cooling rate is preferably at a fast cooling rate of at least 20° C./min. Similarly, plastic strain stored in the workpiece material is easily lost in accordance with structure change, such as recrystallization during a solution heat treatment. Consequently, it is effective to directly carry out a stabilizing treatment as a heat treatment in order to maintain a high GOS of at least 0.7°.

Next, in the present invention, the four-face forged material is subjected to a stabilizing treatment by holding it at 830 to 860° C. for 2 to 10 hours, followed by carrying out an aging treatment by holding it at 740 to 780° C. for 2 to 20 hours to produce an aging-treated material. Accordingly, a γ' phase and a γ" phase that are precipitation-strengthening phases can be finely precipitated while maintaining the high GOS of the four-face forged material. Accordingly, excellent tensile strength can be easily obtained at high temperatures.

As to the stabilizing treatment and the aging treatment, the stabilizing treatment and the aging treatment can be directly applied during the cooling of the four-face forged material or the four-face forged material can be cooled once to around room temperature, followed by reheating to the temperature of the stabilizing treatment.

In addition, when the four-face forged material is produced to fine grains having a grain size number of 6 or more in accordance with ASTM, excellent tensile strength and ductility can be obtained more reliably.

EXAMPLES

Example 1

A alloy 718 billet was prepared, the alloy 718 having a composition comprising, in mass %, C: up to 0.08%, Si: up to 0.2%, Mn: up to 0.2%, P: up to 0.015%, S: up to 0.005%, Fe: 15.0 to 20.0%, Cr: 17.0 to 21.0%, Mo: 2.8 to 3.3%, Al: 0.20 to 0.80%, Ti: 0.65 to 1.15%, Nb: up to 5.8%, Ta: up to 1.0%, B: up to 0.006%, and the balance of Ni (but including 50 to 55%) with inevitable impurities. The billet had the chemical composition shown in Table 1. The content of Ni was approximately 54 mass %. The composition further included Si: 0.04%, Mn: 0.09%, P; 0.006%, and S: 0.0001%, which are not shown in Table 1, and Ta was not added.

Using the billet, upset forging and ring rolling were carried out at a heating temperature of 920 to 1,010° C. to produce a preform for closed die forging having a microstructure having an ASTM grain size number of at least 9. Using the obtained preform, the heat treatment before forging was carried out at a holding temperature of 990° C. for a holding time of 4 hours, followed by carrying out closed die forging from this holding temperature to obtain a closed die forged material having an outer diameter of about 1,300 mm, an inner diameter of about 1,000 mm, and a height of about 110 mm. The temperature of a portion having the highest temperature due to the plasticity-induced heating during forging was 970 to 980° C. After carrying out closed die forging, the closed die forged material was cooled at a cooling rate of approximately 40° C./min or more while controlling its cooling rate from the temperature at which forging was finished to 900° C., followed by air cooling to ambient temperature. In this Example of the present invention, the forged material after cooling was held at 718° C. for 8 hours as the first aging treatment, cooled to 621° C. at 55° C./hour and then held at 621° C. for 8 hours as the second aging treatment. In the Comparative Example, after closed die forging, a solution heat treatment at 980° C. was carried out, followed by the aging treatment.

TABLE 1

(mass %)

| C | Fe | Cr | Mo | Al | Ti | Nb | B | Balance |
|---|---|---|---|---|---|---|---|---|
| 0.023 | 17.8 | 18.0 | 2.9 | 0.48 | 0.97 | 5.42 | 0.0029 | Ni and inevitable impurities |

The microstructure and tensile properties of the aging-treated materials were evaluated. The sampling position of a test piece was a position at which the most plasticity-induced heating was generated during forging. The microstructure was measured by an SEM-EBSD technique to analyze the grain orientation spread (GOS) as an intragranular misorientation parameter obtained by averaging the misorientation of each measured point in grains and all points in grains for every grain. The measurement was conducted in a field of view of 100×100 μm, and the values obtained by weighting the GOS values respectively corresponding to all grains in a field of view of measurement with an area of the grain were defined as representative values in a field of view of measurement. The test piece was sampled from the same position as the measured position of the GOS and a tensile test at 649° C. of a test temperature was carried out in accordance with ASTM-E21. Table 2 shows the GOS values of the aging-treated material and the results of 0.2% proof stress, and it can be seen that as the GOS value increases, tensile strength and 0.2% proof stress tended to increase. No. 1 in the present invention having a GOS value of at least 0.7° had excellent mechanical properties including a tensile strength of at least 1,220 MPa and a 0.2% proof stress of at least 1,050 MPa. On the other hand, in the Comparative Example in which the GOS value was less than 0.7°, 0.2% proof stress was 1,000 MPa or less and tensile strength was 1,150 MPa or less, resulting in low strength compared with those of the present invention. In the Example of the present invention, 0.2% proof stress was 1,090 MPa or more, and thus, effects of generating less deformation at high temperatures and easily repairing used components can be expected.

TABLE 2

| No. | GOS (°) | 0.2% proof stress (MPa) | Tensile strength (MPa) | Note |
|---|---|---|---|---|
| 1 | 0.9 | 1100 | 1222 | Example of the present invention |
| 11 | 0.4 | 979 | 1140 | Comparative Example |

Example 2

A Waspaloy billet was prepared, Waspaloy having a composition including, in mass %, C: 0.02 to 0.10%, Si: up to 0.15%, Mn: up to 0.1%, P: up to 0.015%, S: up to 0.015%, Fe: 2.0%, Cr: 18.0 to 21.0%, Co: 12.0 to 15.0%, Mo: 3.5 to 5.0%, Al: 1.20 to 1.60%, Ti: 2.75 to 3.25%, B: 0.003 to 0.010%, Zr: 0.02 to 0.08%, and the balance of Ni (but including 52 to 62%) with inevitable impurities. The billet had the chemical composition shown in Table 3. The content of Ni was approximately 59 mass %. The composition further included Si: 0.03%, Mn: less than 0.01%, P; 0.001%, and S: 0.0002%, which are not shown in Table 2.

The billet was used to be held at a heating temperature of 1,020 to 1,050° C. for 2 hours, and then four-face forging was carried out from this holding temperature so that the outer diameter was about 360 mm, followed by air cooling to ambient temperature. Three different forged materials were prepared using different cooling rates from the temperature at which the forging was finished to 900° C. Subsequently, the stabilizing treatment was carried out by holding at 843° C. for 4 hours, followed by air cooling to room temperature, and the aging treatment was carried out by further holding at 760° C. for 16 hours.

TABLE 3

(mass %)

| C | Fe | Cr | Co | Mo | Al | Ti | B | Zr | Balance |
|---|---|---|---|---|---|---|---|---|---|
| 0.033 | 0.37 | 19.0 | 13.5 | 4.3 | 1.28 | 2.90 | 0.0052 | 0.05 | Ni and inevitable impurities |

The microstructure and tensile properties of the aging-treated materials were evaluated. The microstructure was measured by an SEM-EBSD technique to analyze the grain orientation spread (GOS) as an intragranular misorientation parameter obtained by averaging the misorientation of each measured point in grains and all points in grains for every grain. The measurement was conducted in a field of view of 500 μm×500 μm, and the GOS values of all grains in a field of view of measurement were weighted by the area of each grain to obtain a representative value in the field of view of measurement. The test piece was sampled from the same position as the measured position of the GOS and a tensile test at 650° C. of a test temperature was carried out in accordance with ASTM-E21. Table 4 shows the GOS values and tensile properties of the aging-treated materials, and as to the cooling rates after forging, the order from the fast cooling rate was No. 2 of the present invention, No. 3 of the present invention and No. 12 of Comparative Example. The ASTM grain size number was 6. It can be seen that elongation and reduction of area of the present invention were equivalent to those of the Comparative Example, but tensile strength was high in No. 2 of the present invention and No. 3 of the present invention having the high GOS values. Furthermore, 0.2% proof stress of No. 2 of the present invention having the highest GOS value was higher than that of No. 3 of the present invention and No. 2 of the present invention had excellent mechanical properties having all of proof stress, tensile strength, and ductility. On the other hand, as to No. 12 of the Comparative Example having less than 0.7° of the GOS, 0.2% proof stress was 600 MPa and tensile strength was 1,050 MPa or less, resulting in low strength as compared with those of the present invention. In the present invention, an application to the components required for high ductility at high temperatures can be expected.

TABLE 4

| No. | Cooling rate (° C./min) | GOS (°) | 0.2% proof stress (MPa) | Tensile strength (MPa) | Elongation (%) | Reduction of area (%) | Note |
|---|---|---|---|---|---|---|---|
| 2 | 24 | 5.0 | 758 | 1065 | 51.4 | 64.8 | Example of the present invention |
| 3 | 17 | 1.1 | 692 | 1066 | 54.5 | 65.3 | Example of the present invention |
| 12 | 13 | 0.5 | 600 | 1022 | 50.6 | 62.7 | Comparative Example |

As shown by the above results, in the Ni-based superalloy applying the manufacturing method of the present invention, excellent tensile strength can be obtained. In addition, the Ni-based superalloy applying the manufacturing method in the present invention can have both excellent tensile strength and ductility in good balance. The reliability of members in jet engines and gas turbines and the like, produced by using the Ni-based superalloy, can be enhanced.

The invention claimed is:

1. A Ni-based superalloy having a composition comprising, in mass %, C: up to 0.10%, Si: up to 0.5%, Mn: up to 0.5%, P: up to 0.05%, S: up to 0.050%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities, wherein the Ni-based superalloy has a grain orientation spread (GOS) of at least 0.7° as an intragranular misorientation parameter measured by an SEM-EBSD technique.

2. The Ni-based superalloy according to claim 1, wherein the composition of the Ni-based superalloy comprises C: up to 0.08%, Si: up to 0.2%, Mn: up to 0.2%, P: up to 0.02%, S: up to 0.005%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities.

3. A method for manufacturing a Ni-based superalloy, the Ni-based superalloy having a composition comprising, in mass %, C: up to 0.10%, Si: up to 0.5%, Mn: up to 0.5%, P: up to 0.05%, S: up to 0.050%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities, and having a grain orientation spread (GOS) of at least 0.7° as an intragranular misorientation parameter measured by an SEM-EBSD technique, the method comprising:

carrying out a heat treatment before closed die forging by heating a material to be hot-worked having the composition at a temperature of 970 to 1,005° C. and holding at the temperature for 1 to 6 hours, and then carrying out closed die forging to produce a closed die forged material; and carrying out an aging treatment step comprising a first aging treatment by holding the closed die forged material at a temperature of 700 to 750° C. for 2 to 20 hours, and a second aging treatment by holding at a temperature of 600 to 650° C. for 2 to 20 hours to produce an aging-treated material.

4. A method for manufacturing a Ni-based superalloy, the Ni-based superalloy having a composition comprising, in mass %, C: up to 0.10%, Si: up to 0.5%, Mn: up to 0.5%, P: up to 0.05%, S: up to 0.050%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities, and having a grain orientation spread (GOS) of at least 0.7° as an intragranular misorientation parameter measured by an SEM-EBSD technique, the method comprising:

carrying out a heat treatment before four-face forging by heating a material to be hot-worked having this composition to a temperature of 980 to 1,050° C. and holding at the temperature for 1 to 6 hours, and then carrying out four-face forging to produce a four-face forged material;

carrying out a stabilizing treatment step by holding the four-face forged material at a temperature of 830 to 860° C. for 2 to 20 hours to produce a stabilizing-treated material; and carrying out an aging treatment step by holding the stabilizing-treated material at a temperature of 740 to 780° C. for 2 to 20 hours to produce an aging-treated material, wherein a cooling rate is faster than 15° C./min from a temperature at which the four-face forging is finished to 900° C.

5. The method for manufacturing a Ni-based superalloy according to claim 3, wherein the composition of the Ni-based superalloy comprises C: up to 0.08%, Si: up to 0.2%, Mn: up to 0.2%, P: up to 0.02%, S: up to 0.005%, Fe: up to 45%, Cr: 14.0 to 22.0%, Co: up to 18.0%, Mo: up to 8.0%, W: up to 5.0%, Al: 0.10 to 2.80%, Ti: 0.50 to 5.50%, Nb: up to 5.8%, Ta: up to 2.0%, V: up to 1.0%, B: up to 0.030%, Zr: up to 0.10%, Mg: up to 0.005%, and the balance of Ni with inevitable impurities.

* * * * *